United States Patent [19]

Oberholtzer

[11] Patent Number: 4,648,426

[45] Date of Patent: Mar. 10, 1987

[54] HOT WATER SUPPLY SYSTEM

[76] Inventor: Steven L. Oberholtzer, 131 E. Lovell, Troy, Mich. 48098

[21] Appl. No.: 746,879

[22] Filed: Jun. 20, 1985

[51] Int. Cl.[4] ..... F24H 1/00; E03C 1/044

[52] U.S. Cl. ..... 137/603; 137/625.41; 126/362

[58] Field of Search ..... 126/362; 237/56, 19; 137/801, 602, 603, 896, 561 R, 625.41, 625.46; 4/194

[56] References Cited

U.S. PATENT DOCUMENTS

| | | | |
|---|---|---|---|
| 1,115,139 | 10/1914 | Wilkes et al. . | |
| 1,969,460 | 8/1934 | Glenn . | |
| 2,255,460 | 9/1941 | Weaver . | |
| 2,515,974 | 7/1950 | Araldsen | 126/362 |
| 2,842,155 | 7/1958 | Peters . | |
| 2,975,802 | 3/1961 | Turak . | |
| 3,776,261 | 12/1973 | Houghton . | |

*Primary Examiner*—Henry Bennett

*Attorney, Agent, or Firm*—Harness, Dickey & Pierce

[57] ABSTRACT

An improved hot water supply system is disclosed which provides hot water from a faucet without requiring water flow for a prolonged period of time necessary to displace water retained within connecting pipe. A significant reduction in the time delay before hot water becomes available is achieved by employing a pair of hot water supply pipes connected to a valve or a flow controller. One of the pipes has an internal diameter which is less than that necessary to provide the maximum flow rate capacity requirement of the outlet. This small diameter pipe, termed the auxiliary pipe, is used to provide hot water when the valve is set at a low flow rate setting and due to its small retained volume, provides hot water quickly. At high flow rate setting, water flow through both a primary and auxiliary pipe is permitted, thereby enabling water to be discharged at the desired maximum flow rate. Various embodiments disclose alternate means for employing several hot water supply pipes.

19 Claims, 5 Drawing Figures

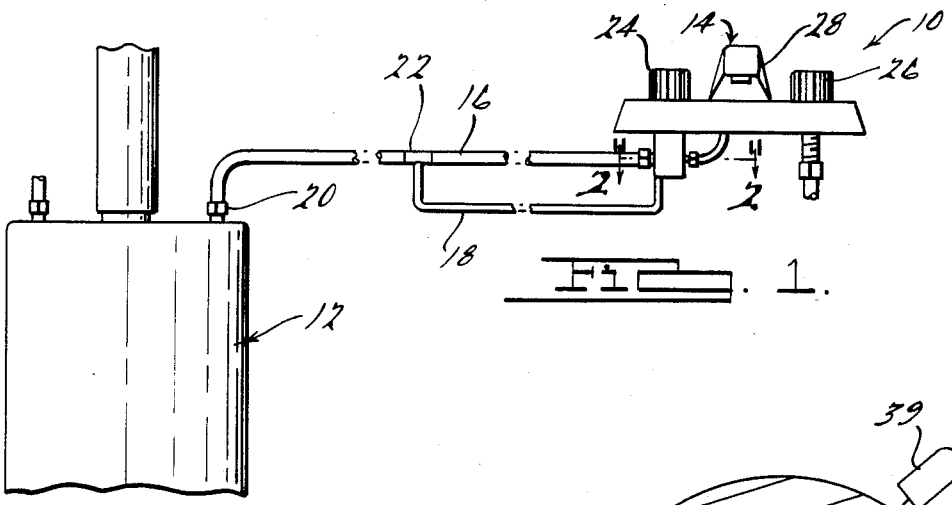
FIG. 1.
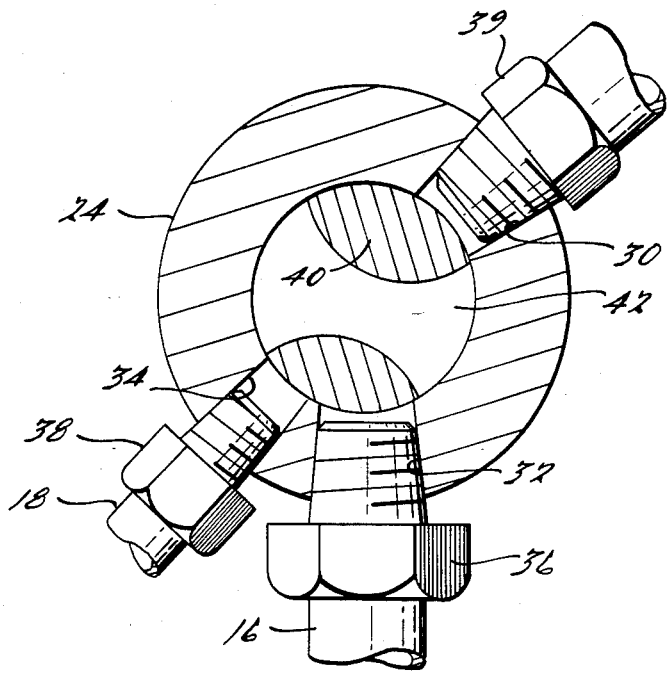
FIG. 2.
FIG. 3.
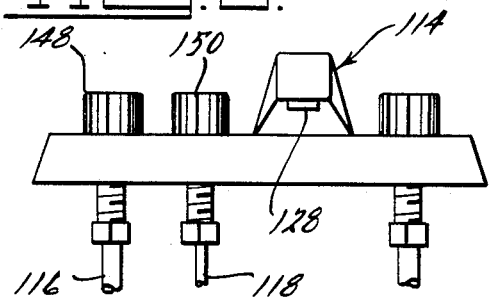
FIG. 4.
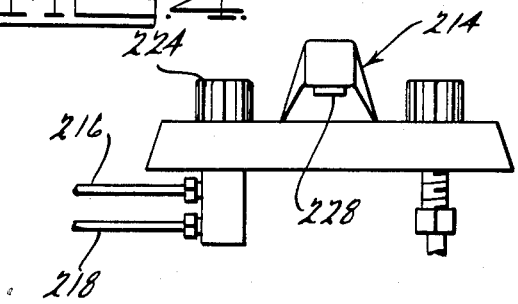
FIG. 5.
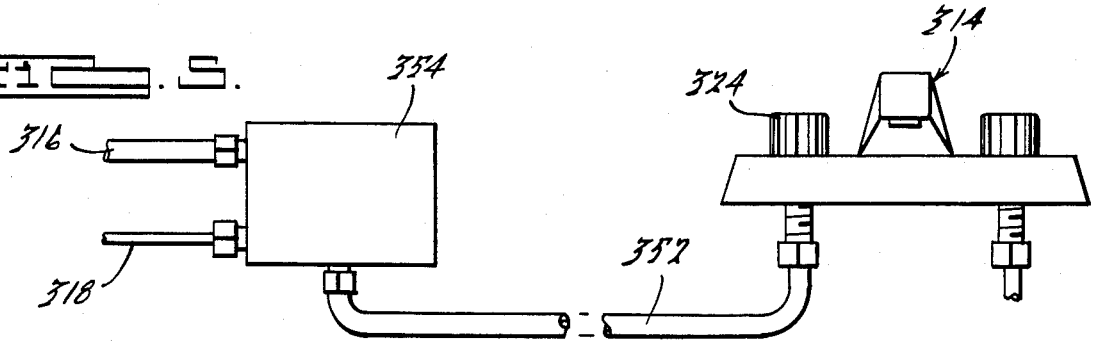

HOT WATER SUPPLY SYSTEM

BACKGROUND AND SUMMARY OF THE INVENTION

This invention relates to an improved hot water supply system and particularly to such systems used in residential and commercial structures wherein hot water is demanded intermittently.

An age-old problem with hot water supply systems has been the necessity for the user to open the hot water valve and permit water to flow from the faucet or nozzle for a considerable period of time before hot water becomes available. This problem exists since the hot water source such as a water heater or boiler is typically located remotely from the point of discharge and is connected between these points by a long supply pipe. Hot water within the supply pipe loses its heat to the environment rapidly once the flow of water therethrough is stopped or significantly reduced. Once the water in the supply pipe has dissipated its heat, the hot water discharge valve must be opened to permit water flow to occur until the cooled water is completely displaced from the connecting pipe. This requirement results in a significant inconvenience to the user and is also highly inefficient from an energy conservation perspective since every use results in the entire connecting pipe being filled with hot water which becomes cooled after the demand is fulfilled.

In many instances, a delay in availability of hot water is not objectionable. However, in some instances where the user desires a small quantity of hot water, for example, for hand and face washing in a bathroom, such a delay constitutes an inconvenience and significant waste of energy since the user only requires a few pints or gallons of hot water and yet the entire volume of the connecting supply pipe must be displaced with hot water before such small quantity becomes available.

Numerous attempts have been made to address the problems of providing hot water quickly and overcoming the inherent inefficiencies of present day hot water supply systems. According to one approach, the hot water supply pipes are encased by a jacket of thermal insulating material. The use of insulation does prevent rapid loss of heat from heated water in supply pipes so that, if hot water is demanded soon after an initial demand, hot water will be immediately available. This approach, however, has the drawback that, following a sufficiently prolonged period of time, heat from the supply pipe will eventually be dissipated to the cooler surrounding environment necessitating the displacement of this cooled water before hot water can be discharged. In many usage conditions, there may be substantial lapses of time between demands for hot water, and therefore, this approach does not overcome the above-described shortcomings of present day hot water supply systems.

Another approach toward addressing the shortcomings of present hot water supply systems is the use of so-called point of source water heaters. These electrically or gas fired water heaters are located at or very close to the point of hot water discharge. These devices rapidly heat water from a supply pipe to provide nearly instantaneous hot water. These devices, however, suffer the disadvantages that they are costly, complicated, bulky and generally require a significant amount of labor for installation.

Another method of addressing the above-mentioned problems is to locate the hot water heater or boiler as close as practicable to the desired point of hot water discharge, thereby minimizing the amount of water which must be displaced within a connecting supply pipe before hot water becomes available. This approach is unsatisfactory, however, where multiple points of hot water discharge are desired, such as in typical homes where several bathrooms or sinks may be located at various remote locations. In such situations, this method of overcoming the problems of present hot water supply systems is useful only for certain of the multiple hot water discharge locations. Moreover, the design of a particular structure may impose constraints on the placement of the water heater or boiler such that the use of long connecting pipes cannot be avoided.

Yet another approach toward minimizing the effects of the above-mentioned shortcomings is to employ a pipe between a hot water source and the point of discharge which is as short as possible and which has as small a diameter as possible, thereby minimizing the total retained volume of water which must be displaced in order to provide hot water once the retained water has cooled. This approach, however, has limitations in that the diameter of the connecting pipe is primarily dictated by the maximum flow rate requirements of the system. For example, many hot water supply systems are used to provide a full residential bathroom including a sink and shower with hot water. The pipe connecting the hot water source with such a bathroom must have a sufficient flow rate capacity to supply the shower and sink during use. In such applications, the use of a small diameter hot water supply pipe would provide hot water more rapidly, but would be unable to fulfill the maximum flow rate requirements of the system.

In view of the above, it is an object of this invention to provide an improved hot water supply system which provides hot water quickly and with high efficiency. It is a further object of this invention to provide such a hot water supply system inexpensively and without complex apparatus. It is an additional object of this invention to provide an improved hot water supply system which is readily adaptable for use with existing hot water supply systems.

The above principal objects of this invention are achieved in accordance with this invention by providing a hot water supply system which employs a pair of pipes which connects the source of hot water with the point of hot water discharge. Valve means in accordance with this invention are employed which permit water flow only through one of the pipes, termed an auxiliary pipe, in situations wherein a small quantity of hot water is desired. When high flow rates of hot water are required, the valve in accordance with this invention permits flow through both the auxiliary and a primary hot water pipe. The auxiliary pipe has a smaller diameter than is dictated by the maximum flow rate requirements and therefore has a lower retained volume which is quickly displaced, enabling hot water to be available without a long delay. When high volumes of water are required, the valve means permits flow through both auxiliary and primary pipes thereby providing sufficient flow rate capacity to fulfill the maximum flow rate requirements dictated by the point of discharge requirements. In situations where only a small volume of hot water is demanded, therefore, water flows only through the auxiliary pipe and due to its small cross-sectional diameter, it retains a smaller volume of hot water, and therefore less energy loss results once the heat retained by this water is dissipated to the environment during prolonged periods wherein the flow rate within the pipe is zero or minimal. Numerous varieties of valve means for systems in accordance with this invention are described herein.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 1 shows the hot water supply system in accordance with a first embodiment of this invention;

FIG. 2 is a cross-sectional view taken along line 2—2 of FIG. 1 showing the internal construction of a flow control valve according to a first embodiment of this invention;

FIG. 3 shows a hot water supply system in accordance with a second embodiment of this invention wherein a pair of hot water supply valves are employed.

FIG. 4 illustrates a third embodiment of this invention wherein a pair of equal diameter hot water supply conduits are employed; and FIG. 5 illustrates a fourth embodiment according to this invention wherein a flow control device is employed to control water flow through a pair of conduits.

DETAILED DESCRIPTION OF THE INVENTION

A hot water supply system according to a first embodiment of this invention is shown in FIGS. 1 and 2 and is generally designated by reference number 10. Hot water supply system 10 includes water heater 12 and faucet assembly 14 with a pair of pipes 16 and 18 connected therebetween. Primary supply pipe 16 would be typically a rigid thin-wall copper or iron pipe directly connected between hot water discharge nipple 20 of water heater 12 and faucet assembly 14. Auxiliary pipe 18 has a diameter less than pipe 16 and can be attached directly to nipple 20 or by T-fitting 22 which is located close to nipple 20. Auxiliary pipe 18 may be of the thin wall flexible copper variety which typically is purchased in coiled rolls and is easily bent by the installer to run from the source of hot water to faucet assembly 14 without the necessity of employing elbows, angle joints, and other fittings.

Faucet assembly 14 includes hot water valve 24 and cold water valve 26. Both valves 24 and 26 are employed to control the flow of water to faucet outlet 28. Cold water valve 26 is connected to any source of cold water (not shown). FIG. 2 is a cross-sectional view through hot water valve 24. Hot water valve 24 is a ball-type valve with discharge port 30 and a pair of inlet ports 32 and 34. Port 32 receives fitting 36 which is connected to primary pipe 16, whereas inlet port 34 receives fitting 38 which connects to auxiliary pipe 18. Port 30 receives fitting 39 which connects with faucet outlet 28 (or may directly connect therewith through internal passageways in faucet assembly 14). Rotatable ball element 40 within hot water valve 24 includes internal passageway 42. Ball element 40 may be rotatable in a counterclockwise direction from the closed off position shown to a first position which permits flow of water flow through auxiliary pipe 18 through discharge port 30 and therefore through faucet outlet 28. Upon continued rotation of ball element 40, water is permitted to flow through both pipes 16 and 18 through faucet 28.

In operation, when the user desires to discharge a small quantity of hot water from faucet outlet 28, hot water valve 24 is rotated to a small angular extent to a position which permits flow through auxiliary pipe 18. A detent (not shown) may be provided to provide a tactile or audible indication to the user that this initial position has been reached. Once port 34 becomes partially or completely uncovered, flow of water through pipe 18 is permitted. Due to the very small diameter of pipe 18, for example, one-fourth inch internal diameter, the total retained volume within pipe 18 is small and therefore water therein which may have dissipated its heat due to a prolonged exposure to the environment becomes quickly displaced with hot water from water heater 12. Since it is desirable to minimize the total retained volume of pipe 18, T-fitting 22 should be located as close to water heater 12 as possible or preferably pipe 18 is connected directly to water heater nipple 20. If, however, the user desires to discharge hot water at a high discharge rate, then hot water valve 24 is rotated counterclockwise until port 32 is uncovered, such that flow through pipe 16 occurs. Passageway 42 is designed so that, when valve 24 is in the fully opened position, water flows through both pipes 16 and 18. If ball element 40 is slowly advanced from a shutoff position to a position permitting flow through both pipes 16 and 18, hot water flowing through pipe 18 will slightly warm the initially cold water flow through pipe 16 until hot water is discharged from both pipes. Such mixing of water from both pipes 16 and 18 prevents a sudden change in outlet water temperature as ball element 40 is advanced from a low flow rate to a high flow rate position.

Due to the fact that auxiliary pipe 18 inherently has a relatively large surface area to volume ratio due to its small diameter, it may be desirable to insulate pipe 18 to prevent excessive heat loss as hot water is transported therethrough.

FIG. 3 illustrates a second embodiment according to this invention wherein faucet assembly 114 includes a pair of hot water valves 148 and 150. Valves 148 and 158 are, in turn, connected to primary pipe 116 and auxiliary pipe 118 respectively, which are both connected to a source of hot water (not shown). Both valves 148 and 150 control the discharge of hot water from faucet outlet 128. In use, the user would select between valves 148 and 150, depending on the desired quantity of hot water desired. If, for example, the user desired a small quantity of hot water for face or hand washing, valve 150 would be selected. Another modification of this embodiment is to eliminate valve 148 and pipe 116 altogether from faucet assembly 114 and use pipe 116 only to supply other water outlets such as a bathtub or shower which inherently requires greater flow rates of water.

FIG. 4 illustrates a third embodiment according to this invention. Hot water valve 224 of faucet assembly 214 includes a pair of ports 232 and 234 (not shown) which are sized to accommodate equal size pipes 216 and 218. In operation, flow occurs only through auxiliary pipe 218 until a nearly fully open position of valve 224 is reached, at which time flow through both pipes 216 and 218 occurs. Pipes 216 and 218 are sized to provide rapid retained water replacement and do not individually have a sufficient cross-sectional diameter to provide the desired maximum flow rate capacity for faucet outlet 228. When flow occurs through both pipes 216 and 218, a sufficient maximum flow rate capability is provided. This embodiment possesses the advantage of convenience in terms of material stocking by the installer, since the same pipe sizes, fittings, etc., are used for both pipes 216 and 218.

FIG. 5 illustrates a fourth embodiment according to this invention wherein a conventional faucet assembly 314 is employed having a hot water valve 324 which receives hot water from connecting pipe 352. A pair of pipes 316 and 318 from a source of hot water are connected to flow controller 354. Pipes 316 and 318 may have differing diameters as described in connection with the first and second embodiments or may have equal diameters according to the third embodiment. In any event, auxiliary pipe 318 has an internal diameter selected for rapid displacement of retained water at low water discharge rates without regard for the maximum discharge flow rate desired for faucet 314. Flow controller 354 preferably has an internal passageway directly connecting pipe 318 with pipe 352 and includes an internal mechanism (not shown) which senses the water flow rate through pipe 352 and controls an internal valve element 354 which permits water flow through primary pipe 316 once a predetermined water flow rate is exceeded. Such control could be achieved by a controller 354 which senses the water pressure in auxiliary pipe 318 or pipe 352 which would change with the position of hot water valve 324. When the static pressure in the pipe drops to a predetermined level, or when the dynamic pressure therein exceeds a predetermined level, controller 354 activates a valve element to permit flow through primary pipe 316.

While the above description constitutes the preferred embodiments of the present invention, it will be appreciated that the invention is susceptible to modification, variation and change without departing from the proper scope and fair meaning of the accompanying claims.

What is claimed is:

1. A hot water supply system adapted to provide hot water at a given maximum flow rate, comprising:

hot water supply means, a water discharge outlet, an auxiliary water supply pipe connecting said discharge outlet with said hot water supply means, said auxiliary pipe having an internal diameter smaller than that necessary to provide water flow at said maximum flow rate whereby means are provided for minimizing the volume of water retained by said auxiliary pipe, a primary water supply pipe connecting said discharge outlet with said hot water supply means, and valve means for controlling water flow through said auxiliary and said primary water supply pipes, said valve means permitting water flow only through said auxiliary pipe at a first setting of said valve means whereby hot water rapidly displaces water in said retained volume of said auxiliary pipe and therefore becoming quickly available at said discharge outlet, said valve means permitting flow through said primary pipe at a second setting of said valves means to provide water at said maximum flow rate.

2. The hot water supply system according to claim 1 wherein said valve means permits flow through both said auxiliary and said primary pipe at said second setting of said valve means.

3. The hot water supply system according to claim 1 wherein said auxiliary pipe has an internal diameter less than the internal diameter of said primary pipe.

4. The hot water supply system according to claim 1 wherein said auxiliary pipe and said primary pipe have equal internal diameters.

5. The hot water supply system according to claim 1 wherein said auxiliary pipe is encased with thermal insulating material.

6. The hot water supply system according to claim 1 wherein said valve means comprises a manually operated ball valve having individual inlet ports for each of said primary and auxiliary supply pipes.

7. The hot water supply system according to claim 1 wherein said valve means comprises individual valve elements for controlling flow through said primary and auxiliary supply pipes.

8. The hot water supply system according to claim 1 further comprising a manually operated water discharge valve and wherein said valve means comprises a flow controller having inlet ports for said primary and auxiliary supply pipes and an outlet port for said water discharge valve, said flow controller responsive to the setting of said water discharge valve to control flow through said primary and auxiliary pipes.

9. The hot water supply system according to claim 6 wherein a detent for said ball valve is provided between said first and second settings of said ball valve.

10. A valve for a hot water supply system adapted to provide hot water at a given maximum flow rate, said hot water supply system including a source of hot water, a water discharge outlet, a primary water supply pipe, and an auxiliary water supply pipe, said auxiliary pipe having an internal diameter smaller than that necessary to provide water at said maximum flow rate whereby means are provided for minimizing the volume of water retained by said auxiliary pipe, comprising:

said valve having a first inlet adapted to be connected to said primary water supply pipe and a second inlet adapted to be connected to said auxiliary water supply pipe, and an outlet port communicating with said water discharge outlet, said valve further having a movable element which permits water flow only through said auxiliary pipe at a first valve setting whereby hot water from said hot water supply means rapidly displaces water in said retained volume of said auxiliary pipe and therefore becomes quickly available at said water discharge outlet, said valve means permitting flow through said primary pipe at a second valve setting whereby water is provided at said maximum flow rate.

11. The hot water supply system according to claim 10 wherein a detent for said valve is provided between said first and second valve settings.

12. A flow controller for a hot water supply system adapted to provide hot water at a given maximum flow rate, said hot water supply system including a source of hot water, a water discharge outlet, a valve for controlling water flow from said water discharge outlet, a primary water supply pipe, and an auxiliary water supply pipe, said auxiliary pipe having an internal diameter smaller than that necessary to provide water at said maximum flow rate whereby means are provided for minimizing the volume of water retained by said auxiliary pipe, comprising:

said flow controller having a first inlet ports connected to said primary pipe and a second inlet port connected to said auxiliary supply pipe and an outlet port communicating with said valve, said flow controller having internal valve means permitting water flow only through said auxiliary pipe at a first setting of said valve whereby hot water from said hot water source rapidly displaces water retained in said retained volume of said auxiliary pipe and therefore becomes quickly available at said water discharge outlet, said flow controller permitting flow through said primary pipe at a second setting of said valve whereby hot water is provided at said maximum flow rate.

13. The flow controller according to claim 12 wherein said flow controller defines an internal passageway connecting said auxiliary water supply pipe with said water outlet port, a pressure sensor which detects the fluid pressure in said passageway and a valve controlled by said pressure sensor which permits flow through said primary pipe when the water flow rate demand at said water discharge outlet exceeds a predetermined level.

14. A hot water supply system adapted to provide hot water to a first discharge outlet having a first maximum water flow rate requirement and to a second discharge outlet having a second maximum water flow rate requirement, said second maximum flow rate requirement being substantially less than said first maximum flow rate requirement, said hot water supply system comprising:

hot water supply means, a first pipe connecting said first discharge outlet with said hot water supply means, a second pipe connecting said second discharge outlet with said hot water supply means, said second pipe having an internal diameter substantially smaller than the internal diameter of said first pipe whereby means are provided for minimizing the volume of water retained by said second pipe such that said water retained within said second pipe becomes displaced and hot water from said hot water supply means becomes quickly available at said second outlet, said first and second discharge outlets operable independently to provide discharged water.

15. A method of quickly providing hot water to a water discharge outlet in a hot water supply system having a given desired maximum water flow rate capability, said hot water supply system having a hot water source, primary and auxiliary supply pipes for conducting said water, said auxiliary pipe having an internal diameter smaller than that necessary to provide said maximum flow rate capability whereby means are provided for minimizing the volume of water retained by said auxiliary pipe, and a valve, comprising the steps of:

controlling the flow of water through said auxiliary pipe such that, at a first position setting of said valve, water flow occurs only through said auxiliary pipe enabling water retained in said auxiliary pipe to be rapidly displaced such that hot water becomes available at said water discharge outlet quickly, controlling the flow of water through said primary pipe such that, at a second position setting of said valve, water flow occurs through said primary pipe enabling water to be supplied to said outlet at said maximum flow rate.

16. A valve for a hot water supply system, said hot water supply system including a source of hot water, a water discharge outlet, a primary water supply pipe, and an auxiliary water supply pipe, said auxiliary pipe having an internal diameter smaller than the internal diameter of said primary supply pipe, whereby means are provided for minimizing the volume of water retained by said auxiliary pipe, comprising:

said valve having a first inlet adapted to be connected to said primary water supply pipe and a second inlet adapted to be connected to said auxiliary water supply pipe, and an outlet port communicating with said water discharge outlet, said valve further having a movable element which permits water flow only through said auxiliary pipe at a first valve setting whereby hot water from said hot water supply means rapidly displaces water in said retained volume of said auxiliary pipe and therefore becomes quickly available at said water discharge outlet at a first discharge flow rate, said valve means permitting flow through said primary pipe at a second valve setting whereby water is provided at a second flow rate, said second flow rate being greater than said first flow rate.

17. The hot water supply system according to claim 16 wherein a detent for said valve is provided between said first and second valve settings.

18. A flow controller for a hot water supply system, said hot water supply system including a source of hot water, a water discharge outlet, a valve for controlling water flow from said water discharge outlet, a primary water supply pipe, and an auxiliary water supply pipe, said auxiliary pipe having an internal diameter smaller than the internal diameter of said primary pipe whereby means are provided for minimizing the volume of water retained by said auxiliary pipe, comprising:

said flow controller having a pair of inlet ports connected to said primary and auxiliary supply pipes and an outlet port communicating with said valve, said flow controller having internal valve means permitting water flow only through said auxiliary pipe at a first setting of said valve whereby hot water from said hot water source rapidly displaces water retained in said retained volume of said auxiliary pipe and therefore becomes quickly available at said water discharge outlet at a first discharge rate, said flow controller permitting flow through said primary pipe at a second setting of said valve whereby hot water is provided at a second flow rate, said second flow rate being greater than said first flow rate.

19. A method of quickly providing hot water from a water discharge outlet in a hot water supply system, said hot water supply system having a hot water source, primary and auxiliary supply pipes for conducting said water, said auxiliary pipe having an internal diameter smaller than the internal diameter of said primary pipe whereby means are provided for minimizing the volume of water retained by said auxiliary pipe, and a valve, comprising the steps of:

controlling the flow of water through said auxiliary pipe such that, at a first position setting of said valve, water flow occurs only through said auxiliary pipe enabling water retained in said auxiliary pipe to be rapidly displaced such that hot water becomes available at said water discharge outlet at a first flow rate, controlling the flow of water through said primary pipe such that, at a second position setting of said valve, water flow occurs through said primary pipe enabling water to be supplied to said outlet at a second flow rate, said second flow rate being greater than said first flow rate.

* * * * *